US008635071B2

(12) United States Patent
Chung et al.

(10) Patent No.: US 8,635,071 B2
(45) Date of Patent: Jan. 21, 2014

(54) APPARATUS, MEDIUM, AND METHOD FOR GENERATING RECORD SENTENCE FOR CORPUS AND APPARATUS, MEDIUM, AND METHOD FOR BUILDING CORPUS USING THE SAME

(75) Inventors: Jihye Chung, Seoul (KR); Jeongmi Cho, Gyeonggi-do (KR); Kihyun Choo, Seoul (KR); Jeongsu Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1459 days.

(21) Appl. No.: 11/059,601

(22) Filed: Feb. 17, 2005

(65) Prior Publication Data

US 2005/0197839 A1 Sep. 8, 2005

(30) Foreign Application Priority Data

Mar. 4, 2004 (KR) ..... 10-2004-0014596

(51) Int. Cl.
*G10L 13/00* (2006.01)

(52) U.S. Cl.
USPC ..... 704/260

(58) Field of Classification Search
USPC ..... 704/10, 7, 258, 260, 266, 270
See application file for complete search history.

(56) References Cited

U.S. PATENT DOCUMENTS

| | | | | |
|---|---|---|---|---|
| 6,505,158 | B1 * | 1/2003 | Conkie | 704/260 |
| 6,823,309 | B1 * | 11/2004 | Kato et al. | 704/267 |
| 6,950,798 | B1 * | 9/2005 | Beutnagel et al. | 704/260 |
| 6,980,955 | B2 * | 12/2005 | Okutani et al. | 704/258 |
| 7,369,994 | B1 * | 5/2008 | Beutnagel et al. | 704/258 |
| 2003/0028369 | A1 * | 2/2003 | Aso | 704/10 |
| 2005/0027532 | A1 * | 2/2005 | Okutani et al. | 704/260 |
| 2005/0209855 | A1 * | 9/2005 | Okutani et al. | 704/256.4 |

FOREIGN PATENT DOCUMENTS

| | | |
|---|---|---|
| JP | 7-334507 | 12/1995 |
| JP | 11-272383 | 10/1999 |
| KR | 10-2001-0044202 | 6/2001 |
| KR | 2001-0095385 | 11/2001 |
| KR | 10-0387231 | 5/2003 |
| KR | 10-2003-0060588 | 7/2003 |

* cited by examiner

*Primary Examiner* — Angela A Armstrong
(74) *Attorney, Agent, or Firm* — Staas & Halsey LLP

(57) ABSTRACT

A method, medium, and apparatus for generating a record sentence to establish a speech corpus, including generating a synthesized sentence of speech and synthesis information related to speech synthesis by performing speech synthesis for a predetermined sentence of text, selecting an unseen sentence including an unseen unit according to the synthesis information, generating a weight indicating a recording priority of the unseen unit included in the selected unseen sentence, and generating a record sentence by combining the unseen unit with the speech synthesis information according to the generated weight.

44 Claims, 8 Drawing Sheets

APPARATUS, MEDIUM, AND METHOD FOR GENERATING RECORD SENTENCE FOR CORPUS AND APPARATUS, MEDIUM, AND METHOD FOR BUILDING CORPUS USING THE SAME

CROSS-REFERENCE TO RELATED APPLICATION

This application claims the priority of Korean Patent Application No. 2004-14596, filed on Mar. 4, 2004, in the Korean Intellectual Property Office, the disclosure of which is incorporated herein by reference.

BACKGROUND OF THE INVENTION

1. Field of the Invention

The present invention relates to a record sentence generation method, and more particularly, to a method for automatically generating a record sentence that is a subject of speech corpus building.

2. Description of the Related Art

Speech synthesis is the conversion of a visually recognizable sentence of text into an acoustically recognizable sentence of speech. Speech synthesis is generally used in automatic response systems, mobile phone number retrieval, and automatic announcement systems in public places.

A conventional speech synthesis apparatus extracts text information from a sentence of text, selects the most appropriate prerecorded vocal elements according to the extracted text information, and combines the selected vocal elements to generate a sentence of speech. Here, a speech unit obtained by dividing prerecorded speech into parts of a predetermined size is referred to as a candidate synthesis unit.

A synthesis unit database is established according to a database referred to as a speech corpus. The speech corpus is established by prerecording common source or frequently used sentences. For example, the sources may be novels, news articles, and academic publications, etc. A speech synthesis method according to the above-described type of speech corpus is referred to as corpus-based speech synthesis (CSS).

The quality of speech synthesized by CSS depends on the method of establishing the speech corpus and the amount of speech stored in the speech corpus. However, since it is impossible to store all possible sentences of speech in a speech corpus, there is inevitably quality degradation due to an unseen unit in a synthesized sentence. For example, when a speech unit of satisfactory quality cannot be obtained from candidate synthesis units extracted from a speech corpus by a speech synthesizer, a less-than-satisfactory candidate synthesis unit is selected as a synthesis unit and referred to as an "unseen unit".

The unseen unit is a major cause of quality degradation of a synthesized sentence of speech. To solve the unseen unit problem, U.S. Pat. No. 6,505,158 suggests a likely unit replacement method and Korean Patent Application No. 2001-95385 suggests a method using a multi-stage synthesis unit.

For example, in the likely unit replacement method, a most likely candidate synthesis unit is selected and used for replacement according to the likeness between a current phoneme and preceding and succeeding phonemes. For example, in the method using a multi-stage synthesis unit, when there is no desired candidate synthesis unit, a smaller synthesis unit is selected and used for replacement.

However, in the likely unit replacement method, even when the likeness is high, phoneme transition, and the like may cause phonemes to have totally different sound values such that the method cannot prevent degradation of speech quality. When the replacement unit is also an unseen unit, replacement itself becomes impossible. Also, in the method using a multi-stage synthesis unit, the smaller the unit used in synthesis, the larger the probability of errors occurring in the connection part, and when the replacement unit is also an unseen unit, replacement itself becomes impossible.

Accordingly, the most basic method for solving the unseen unit problem is to maximize the efficiency of a speech corpus. The efficiency of a speech corpus may be increased by building the speech corpus such that a relatively small number of sentences of speech can cover a large number of unseen units. Thus, a script to be read by a voice actor, that is, record sentences, must be selected appropriately such that a small number of record sentences cover a large number of unseen units.

FIG. 1 is a diagram showing a conventional method of establishing a speech corpus.

A text database 110 having sentences of text extracted from various books and publications is established. The text database 110 includes sentences of text and additional information including syntax and morpheme information on the sentences of text. A sentence extracted from the text database 110 is converted into a sentence of speech with a speech signal waveform by being spoken by a voice actor and recorded. The converted sentences of speech and related information form a speech corpus 100. The established speech corpus 100 includes information on a sentence of text underlying a sentence of speech, additional information on the sentence of text, a signal waveform indicating the sentence of speech, mapping information between the sentence of speech and the sentence of text, and the label of a phoneme included in the sentence of speech.

The established speech corpus 100 is used to build a synthesis database 120 which is used in a variety of speech synthesis fields. The synthesis database 120 is included inside a speech synthesizer, and is formed with information extracted from the speech corpus and processed appropriately for a particular application field.

However, the conventional method for establishing a speech corpus has an omnidirectional structure in which the steps of establishing the text database 110, selecting appropriate record sentences from the text database 110, recording and storing the selected record sentences to form the speech corpus 100, and using the speech corpus 100 to form the synthesis database 120 are performed only in one direction. Accordingly, unseen unit problems caused by new speech synthesis performed after the speech corpus 100 is built cannot be solved.

SUMMARY OF THE INVENTION

Embodiments of the set forth invention include a method, medium, and apparatus for generating a record sentence to establish a speech corpus, including: generating a synthesized sentence of speech and synthesis information indicating information related to speech synthesis by performing speech synthesis for a predetermined sentence of text; selecting an unseen sentence including an unseen unit based on according to the synthesis information; generating a weight indicating a recording priority of an unseen unit contained in the selected unseen sentence; and generating a record sentence by combining an unseen unit based on according to the generated weight.

According to an embodiment of the invention, there is provided a method for generating a record sentence to establish a speech corpus, including generating a synthesized sentence of speech and synthesis information related to speech synthesis by performing speech synthesis for a predetermined sentence of text, selecting an unseen sentence including an unseen unit according to the synthesis information, generating a weight indicating a recording priority of the unseen unit included in the selected unseen sentence, and generating a record sentence by combining the unseen unit with the speech synthesis information according to the generated weight.

According to an embodiment of the invention, there is further provided text information that is syntactic interpretation information regarding a synthesis unit and a text unit related to the speech synthesis.

According to an embodiment of the invention, there is further provided synthesis unit information that is phonetic interpretation information regarding a synthesis unit and a text unit related to the speech synthesis.

According to another embodiment of the invention, the method of generating the weight includes extracting the unseen unit included in the selected unseen sentence, and generating the weight for the extracted unseen unit, wherein the weight for the unseen unit is determined according to a linguistic criterion and/or a phonetic criterion for the unseen unit.

According to an embodiment of the invention, the weight for the unseen unit is determined according to at least one of the frequency of occurrence of the unseen unit, a type of a word having the unseen unit, a part of speech of the unseen unit, a matching rate of the unseen unit, and/or a distortion rate of the unseen unit.

According to an embodiment of the invention, the method for generating the record sentence further includes selecting the unseen unit according to the unseen unit weight, and generating a record sentence by combining the selected unseen unit with the speech synthesis information.

According to an embodiment of the invention, the method for generating the record sentence by combining the selected unseen unit with the speech synthesis information includes generating a first candidate record sentence by combining the selected unseen unit with the speech synthesis information, and generating a second candidate record sentence by performing at least one of word replacement, word addition, content word replacement, content word addition, and/or sentence structure modification.

According to an embodiment of the invention, there is provided a medium that includes a computer readable code for performing the method of generating the record sentence of claim 1.

According to another embodiment of the invention, there is provided an apparatus for generating a record sentence for establishing a speech corpus, the apparatus including a speech synthesis unit that generates a synthesized sentence of speech and synthesis information indicating information related to speech synthesis by performing speech synthesis for a predetermined sentence of text, an unseen sentence selection unit that selects an unseen sentence including an unseen unit according to the generated synthesis information, a generation unit extraction unit that generates a weight indicating a recording priority of an unseen unit included in the selected unseen sentence, and a record sentence generation unit that generates a record sentence by combining an unseen unit with the speech synthesis information according to the generated weight.

According to an aspect of the invention, the synthesis information includes text information that is syntactic interpretation information regarding a synthesis unit and a text unit related to speech synthesis.

According to an aspect of the invention, the synthesis information includes synthesis unit information that is phonetic interpretation information regarding a synthesis unit and a text unit related to speech synthesis.

According to an aspect of the invention, the text information includes at least one of a type of the sentence, parts of speech, information on whether a word is an unseen unit, word information, parsing information of the sentence, and/or pause information.

According to an aspect of the invention, the unseen sentence selection unit selects the unseen sentence according to at least one of the number of candidate synthesis units extracted from a synthesis database when speech synthesis is performed, and/or a replacement satisfaction degree of a replacement unit selected when speech synthesis is performed.

According to an aspect of the invention, the unseen sentence selection unit selects the unseen sentence according to a phonetic quality level of the unseen sentence of speech.

According to an aspect of the invention, the unseen sentence selection unit selects the unseen sentence according to a prosody matching rate when the synthesis unit is synthesized and/or according to a distortion rate of a signal waveform of the synthesis unit.

According to an aspect of the invention, the generation unit extraction unit extracts the unseen unit included in the selected unseen sentence, and generates a weight for the extracted unseen unit that is calculated according to a linguistic criterion and/or a phonetic criterion of the unseen unit.

According to an aspect of the invention, the record sentence generation unit selects the unseen unit according to the unseen unit weight, generates a first candidate record sentence by combining the selected unseen unit with the speech synthesis information by performing at least one of a word replacement, a word addition, content word replacement, content word addition, and/or sentence structure modification, and generates a second candidate record sentence.

According to an aspect of the invention, the generation of the second candidate record sentence is performed according to at least one of morpheme analysis, syntax analysis, dependent structure analysis, case structure analysis, and/or semantic analysis.

According to yet another aspect of the invention, there is provided an apparatus for establishing a speech corpus including a speech synthesis unit that performs speech synthesis for a predetermined sentence of text, an unseen unit selection unit that extracts an unseen unit from an unseen sentence by using synthesis information related to the speech synthesis, a record sentence generation unit that generates a record sentence according to the extracted unseen unit, and a speech signal conversion unit that converts the record sentence into a speech signal and stores the speech signal in the corpus.

According to an aspect of the invention, the unseen unit selection unit generates a weight according to a linguistic criterion and/or a phonetic criterion for the unseen unit, and extracts the unseen unit in order according to the generated weight.

According to an aspect of the invention, the record sentence generation unit generates a first candidate record sentence by combining the extracted unseen unit with speech synthesis information, and generates a second candidate record sentence by performing a word replacement for the first candidate record sentence.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
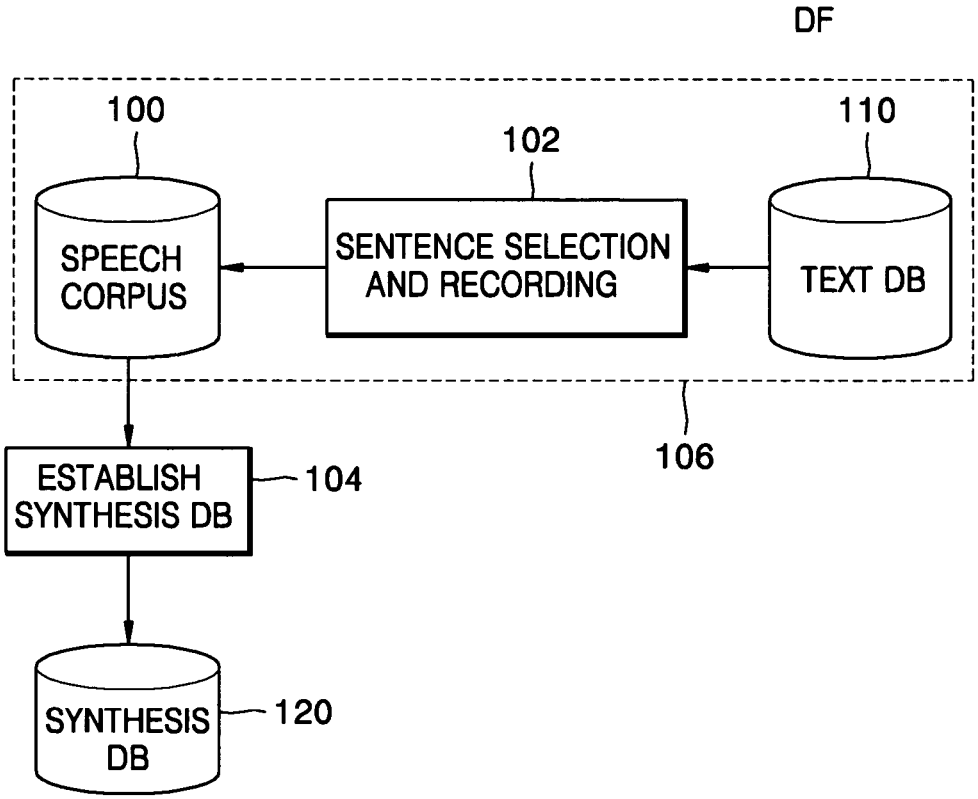
FIG. 1 (PRIOR ART)
FIG. 1 is a diagram showing a conventional method for establishing a speech corpus.

Reference will now be made in detail to the embodiments of the present invention, examples of which are illustrated in the accompanying drawings, wherein like reference numerals refer to the like elements throughout. The embodiments are described below to explain the present invention by referring to the figures.

In the embodiments described below, a record sentence refers to words spoken by a person, e.g., voice actor, to establish a speech corpus. Specifically, the record sentence is any word, clause, or phrase or a group of clauses or phrases forming a syntactic unit or linguistic element.

Figure 2:
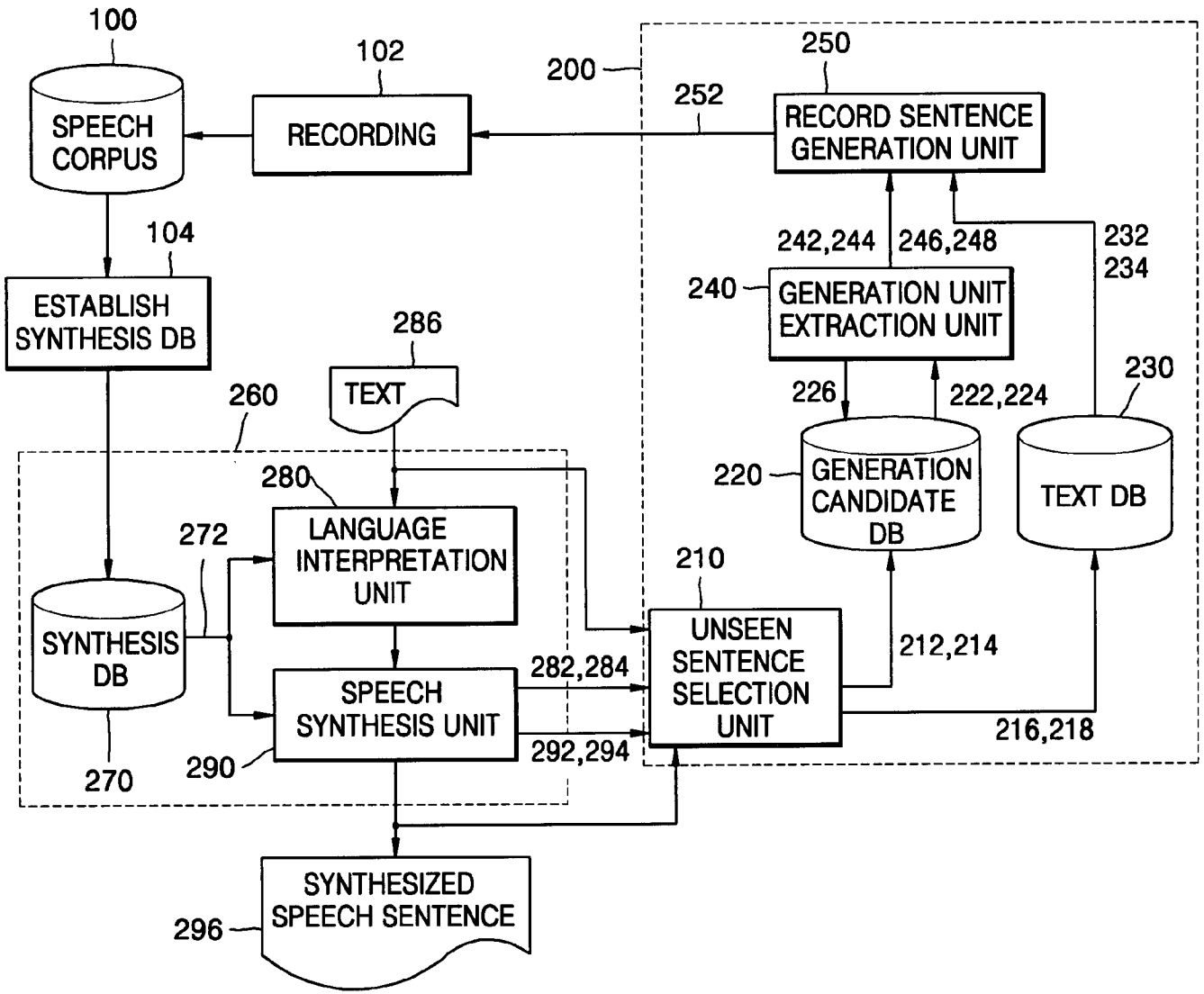
FIG. 2 is a schematic diagram of the structure of a method for establishing a speech corpus using a sentence generation method according to an embodiment of the invention.

FIG. 2 is a schematic diagram of the structure of a device establishing a speech corpus using a sentence generation method according to an embodiment of the invention.

The method for establishing a speech corpus according to the present invention includes a conventional speech synthesis operation and a sentence generation operation for generating a record sentence by using information generated in the speech synthesis operation. The speech synthesis operation is performed by a speech synthesizer 260 and the sentence generation operation is performed by a sentence generator 200. The record sentence may be, for example, a script to be read by a person, stored in a text database.

First, the speech synthesis process performed by the speech synthesizer 260 is briefly explained below.

The speech synthesizer 260 may be a similar apparatus that is used to perform speech synthesis in the conventional method described above, and includes a language interpretation unit 280 and a speech synthesis unit 290. The speech synthesizer 260 receives a sentence of text 286 and performs speech synthesis such that a synthesized sentence of speech 296 is generated.

The language interpretation unit 280 receives a sentence of text 286 desired to be synthesized into speech, extracts a candidate synthesis unit 272 corresponding to a text unit included in the sentence of text 286 from a synthesis database, and performs syntactic interpretation on the sentence of text 286 and the text unit to generate text information 284. The text information 284 is linguistic and syntactic interpretation information on the sentence of text 286 and the text unit, and includes a type of the sentence, parts of speech, information on whether a word is registered, a word information, the parsing information of a sentence, and/or pause information.

The speech synthesis unit 290 receives a text unit, receives the text information 284 from the language interpretation unit 280, receives candidate synthesis units transmitted from the synthesis database 270, generates synthesis unit information 294 on the candidate synthesis units, and according to this, selects a synthesis unit to synthesize a sentence of speech. For example, the synthesis unit information 294 is information related to a synthesis unit used in speech synthesis and candidate synthesis units, and all information generated in the speech synthesis process of the speech synthesis unit 290. The text information 284 and synthesis unit information 294 generated in the speech synthesis operation of the speech synthesizer 260 are input to the sentence generator 200 as synthesis information and used to select a record sentence.

The method for generating a sentence according to an embodiment of the invention is discussed herein below.

The sentence generation method is performed by the sentence generator 200 in the process of establishing a speech corpus. The sentence generator 200 receives synthesis information from the speech synthesizer 260 and generates a record sentence 252.

The sentence generator 200 includes an unseen sentence selection unit 210, a generation candidate database 220, a text database 230, a generation unit extraction unit 240, and a record sentence generation unit 250.

The generated record sentence 252 is recorded by a recording unit 102, and stored in a speech corpus 100. The speech corpus 100 is updated by the synthesis database 270 such that a new candidate synthesis unit 272 to be used in subsequent speech synthesis is provided to the speech synthesizer 260.

The process for establishing a speech corpus using the sentence generation method has a feedback structure in which a record sentence generated by the sentence generator 200 is automatically recorded and is reflected in the establishment of the speech corpus. For example, according to the speech corpus establishing method a record sentence including an unseen unit that is found whenever a speech synthesis process is performed, is automatically stored and updated in the speech corpus 100 underlying the establishment of a synthesis database.

Figure 3:
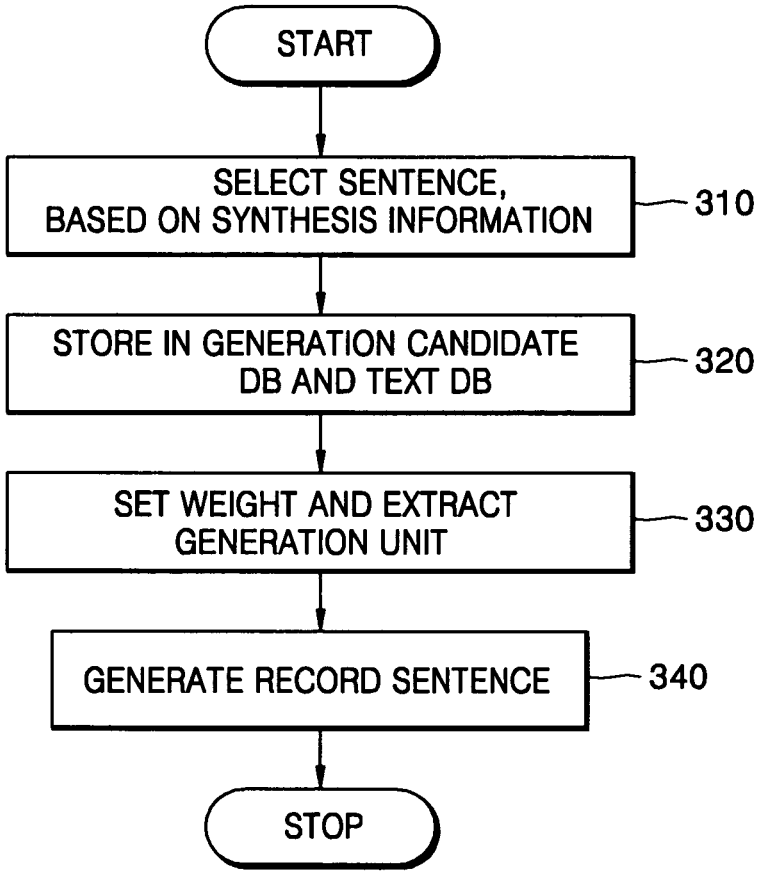
FIG. 3 is a flowchart of a method for generating a record sentence according to an embodiment of the invention.

FIG. 3 is a flowchart of operations performed in a method for generating a record sentence according to an embodiment of the invention.

Referring to FIGS. 2 and 3, the sentence selection unit 210 classifies sentences of speech synthesized according to the synthesis information 286, 296, 282, 284, 292, and 294 extracted from the speech synthesizer 260, into unseen sentences and complete sentences in operation 310.

The sentence selection unit 210 stores unseen sentences and other information in the generation candidate database 220, and stores complete sentences 216 and other information in the text database 230 in operation 320.

The generation candidate unit extraction unit 240 extracts an unseen unit 224 from an unseen sentence stored in the generation candidate database 220, sets a weight 226 for the unseen unit 224, and then transmits the weight 226 and the unseen unit 224 to the record sentence generation unit 250 in operation 330.

The record sentence generation unit 250 generates a record sentence 252 according to the transmitted unseen unit, that is, the generation unit, the weight, and a complete sentence 232 transmitted by the text database 230 in operation 340.

Referring to FIGS. 4 through 7, each operation of the process of FIG. 3 is discussed in more detail, and when necessary, reference numerals for elements of FIG. 2 will be used.

Figure 4:
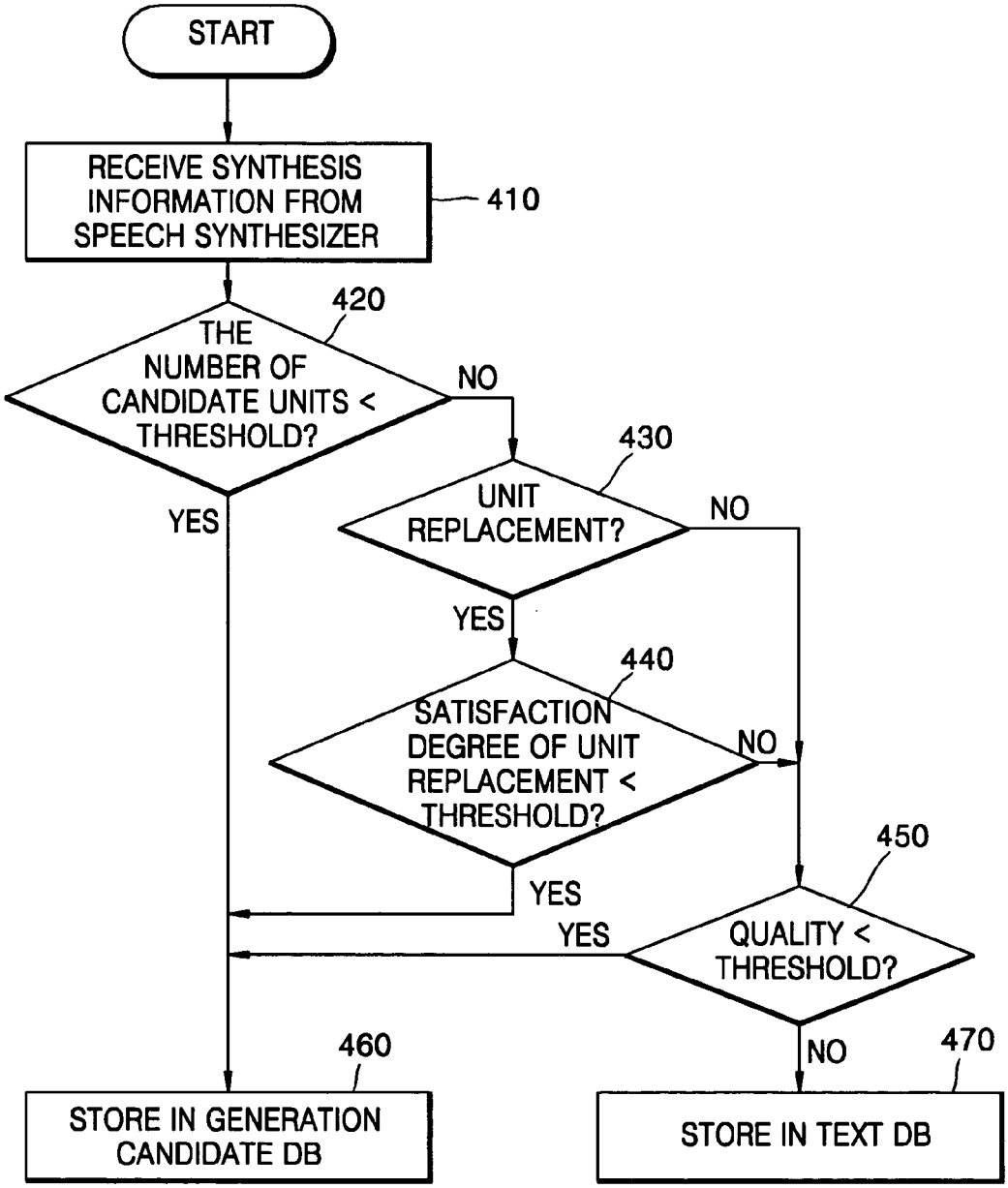
FIG. 4 is a flowchart of a method of an unseen sentence selection unit selecting an unseen sentence according to an embodiment of the invention.

FIG. 4 is a flowchart showing a process of an unseen sentence selection unit selecting an unseen sentence.

The unseen sentence selection unit 210 classifies sentences of speech 296 synthesized by the speech synthesizer 260 into unseen sentences 212 and complete sentences 216. An unseen sentence is a sentence having an unseen unit and complete sentences are all synthesized sentences that do not have any unseen units. For example, the criteria for determining whether a unit is an unseen unit may include a linguistic criterion, a phonetic criterion of a synthesized sentence of speech, or a statistical criterion for efficient speech synthesis. The determination criteria are provided to the unseen sentence selection unit 210 by the speech synthesizer 260 as synthesis information.

In operation 410, the unseen sentence selection unit 210 receives synthesis information generated in the process of speech synthesis, from the speech synthesizer 260. The synthesis information includes the synthesized sentence of speech 296, the sentence of text 286, the text unit 282, the text information 284, the synthesis unit 292, the synthesis unit information 294, and other information.

In operations 420 through 450, according to the synthesis information received from the speech synthesizer 260, unseen sentences are classified according to a user-defined criterion. As described above, the synthesis information includes the sentence of text 286, the text unit 282, the text information 284, the synthesis unit 292, the synthesis unit information 294, and the synthesized sentence of speech 296.

Here, the synthesis unit information includes: i) information on candidate synthesis units, such as the number of candidate synthesis units, ii) information on whether to replace a unit, and information relating to a replacement satisfaction degree, and iii) phonetic quality information, such as a prosody matching rate when a synthesis unit is synthesized, and the distortion rate of a signal waveform of a synthesis unit.

In operation 420, when the number of candidate units included in the synthesis unit information 294 is less than a predetermined threshold, the unseen sentence selection unit 210 classifies the sentence of speech 296 that is received from the speech synthesizer 260 and corresponds to the information, as an unseen sentence.

In operation 430, according to information on whether to replace a unit, included in the synthesis unit information 294, the unseen sentence selection unit 210 determines whether the synthesis unit used in speech synthesis is used by a unit replacement method.

If the synthesis unit used in the speech synthesis is used by the unit replacement method, then in operation 440, it is determined whether a unit replacement satisfaction degree also included in the synthesis unit information is less than a threshold. If the replacement satisfaction degree is less than the threshold, the sentence of speech is classified as an unseen sentence. In operation 440, if the unit replacement satisfaction degree is greater than the threshold, operation 450 is performed.

In operation 450, according to phonetic quality information included in the synthesis unit information 294, the unseen sentence selection unit 210 determines whether the quality of the synthesized sentence is less than a predetermined threshold. If the quality of the synthesized sentence is less than the predetermined threshold, the sentence of speech is classified as an unseen sentence. Otherwise, it is classified as a complete sentence.

In operation 460, the unseen sentence selection unit 210 stores the unseen sentences classified in steps 420 through 450 and unseen sentence additional information 214 which is the synthesis information on the unseen sentences, in the generation candidate database 220. The unseen sentence additional information 214 includes text information on a text unit included in each unseen sentence, and synthesis unit information on a synthesis unit corresponding to the text unit.

Also, in operation 470, the unseen sentence selection unit 210 stores complete sentences 216 classified in operations 420 through 450, and complete sentence additional information 218 which is the synthesis information on the complete sentences 214, in the text database 230. Unlike the unseen sentence additional information 214, the complete sentence additional information 218 includes only linguistic information on a text unit included in each sentence. This is because the text database 230 provides only text units required for generating a record sentence.

In FIG. 4, each of operations 420 through 450 is selective, and one or more operations may be omitted according to an embodiment of the invention. For example, only the number of candidate synthesis units can be used as a criterion to determine an unseen sentence, and in this case, operations 430 through 450 will be omitted.

Figure 5:
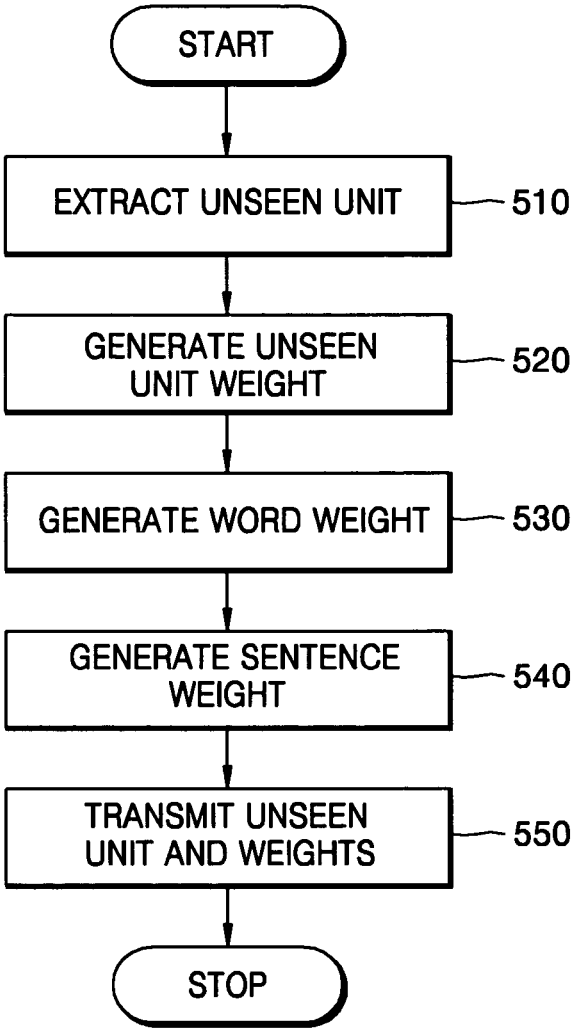
FIG. 5 is a flowchart showing a process of a generation unit extraction unit extracting an unseen unit and providing the extracted unseen unit to a record sentence generation unit according to an embodiment of the invention.

FIG. 5 is a flowchart showing a process of a generation unit extraction unit extracting an unseen unit and providing it to a record sentence generation unit.

In operation 510, the generation candidate extraction unit 240 extracts an unseen unit 222 from the generation candidate database 240.

In operation 520, the generation candidate extraction unit 240 generates a weight of an unseen unit, that is, an unseen unit weight, according to the unseen sentence additional information 214 included in the generation candidate database 240. The unseen unit weight indicates a priority index by which an unseen unit is generated for a record sentence. The unseen unit weight is a value numerically expressed according to a linguistic criterion of text information extracted from unseen sentence additional information, or according to a phonetic criterion of synthesis unit information. The unseen unit weight is used as a criterion of selection order for units generating a record sentence in the record sentence generation unit 250.

The unseen sentence additional information 214 is synthesis information of an unseen sentence, and includes text information on an unseen unit included in an unseen sentence, and synthesis unit information. Accordingly, the unseen unit weight can be generated according to the unseen sentence additional information 214.

Some examples of the linguistic criterion described above include: i) how often the extracted unseen unit occurs, ii) whether the extracted unseen unit is included in a repeatedly occurring word, and iii) what the part of speech of the extracted unseen unit is. Some examples of the phonetic criterion described above include: i) the degree to which a lasting time, frequency, and size of the extracted unseen unit match those of a most preferable synthesis unit having a quality desired by a user, e.g., a target unit (a matching rate), and ii) an amount of distortion of the extracted unseen unit with respect to other synthesis units, or neighboring units (a distortion rate). For example, the more often the unseen unit occurs, or the more frequently occurring a word to which the unseen unit belongs, or the lower the matching rate, or the higher the distortion rate, the greater the generated unseen unit weight.

In operations 530 and 540, a weight for a word or a sentence is generated. Operations 530 and 540 are optional and may be omitted.

In operation 530, for one word including the extracted unseen unit, the generation unit extraction unit 240 generates a word weight from the unseen unit weight of the unseen unit included in the word and unseen sentence additional information related to the morpheme. The unseen sentence additional information related to the morpheme is linguistic and phonetic information in units of words, and can be generated from synthesis information, and indicates, for example, the type of a word, the location of a word, and the matching rate and distortion rate when a word is synthesized.

Also, in operation 540, for a sentence including the unseen unit, the generation candidate extraction unit 240 generates a sentence weight from the weight of the unseen unit included in the sentence, the word weight included in the sentence, and unseen sentence additional information related to the sentence. The unseen sentence additional information related to the sentence is linguistic and phonetic information seen in units of sentences, and indicates, for example, the type of a sentence.

The generation candidate extraction unit 240 transmits the extracted unseen unit 242, the generated unseen unit weight 244, the word weight 246, and the sentence weight 248, to the record sentence generation unit 250. The extracted unseen unit 242 becomes a unit for generating a sentence, that is, a generation unit, in the record sentence generation unit 250.

Figure 6:
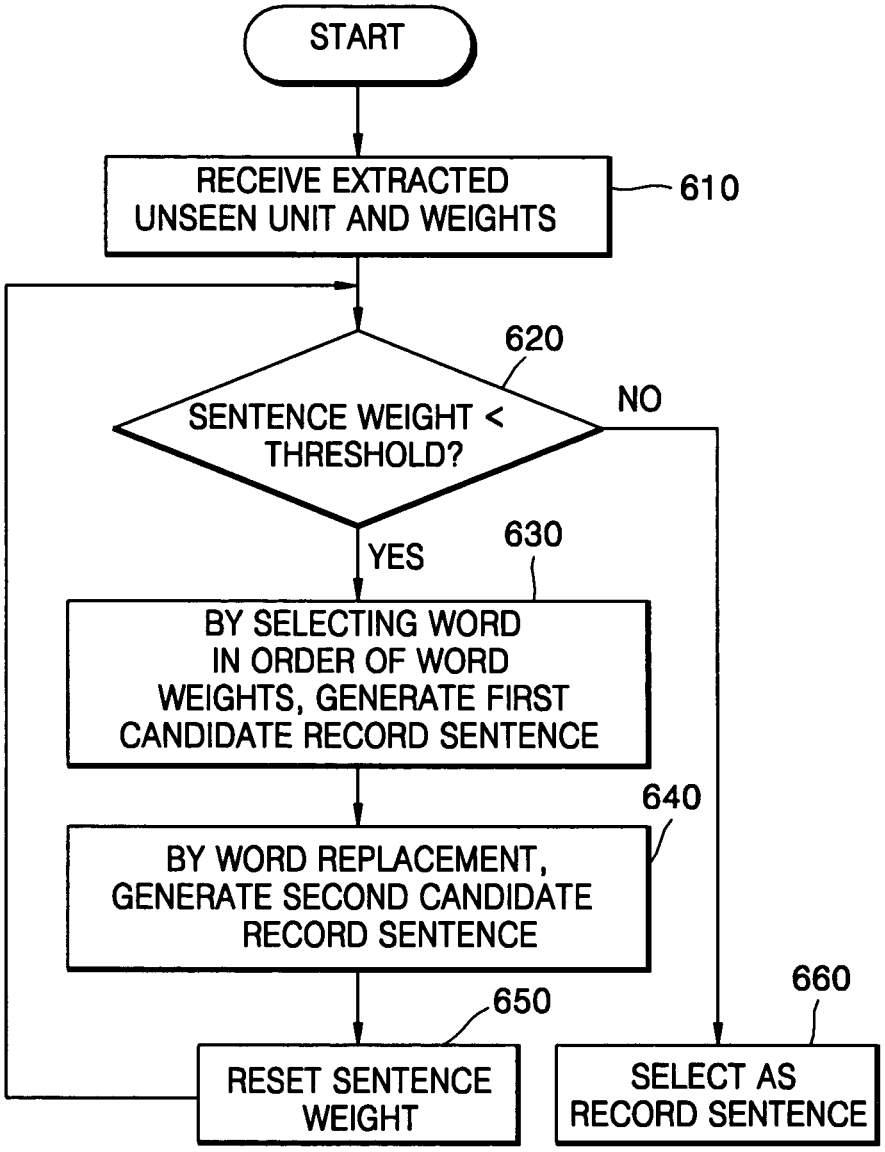
FIG. 6 is a flowchart showing a method of generating a record sentence according to an embodiment of the invention.

FIG. 6 is a flowchart showing a process of generating a record sentence.

In operation 610, the record sentence generation unit 250 receives the extracted unseen unit 242, the generated unseen unit weight 244, the word weight 246, and the sentence weight 248, from the generation unit extraction unit 240

In operation 620, it is determined whether or not the sentence weight 248 is less than a predetermined threshold. When the sentence weight 248 is less than the predetermined threshold, operations 630 through 660 are performed following a record sentence generation process. A sentence including the extracted unseen unit cannot be used as a record sentence as is.

In operation 630, words are selected in order of decreasing word weight, and by combining selected words, a first candidate record sentence is generated. Since the generated first candidate record sentence is formed only with words including unseen units, it is not appropriate as a record sentence because it is difficult for a voice actor to pronounce a grammatically incomplete sentence. As a result, the recording process is not smooth and the quality of the recorded speech signal is easily degraded.

In operation 640, a sentence of text 232 including the word selected in operation 630, and text information, are received from the text database 230, and according to the received sentence of text 232 and text information 234, a second candidate record sentence is generated by performing word replacement, word addition, content word replacement, content word addition, and sentence structure modification, generating a second candidate record sentence.

Sentence generation may be performed by a variety of linguistic information items.

Linguistic information includes morpheme analysis information, syntax analysis information (dependent structure analysis, and case structure analysis), and semantic analysis. The dependent structure analysis is a process of analyzing the connection between words according to the grammar of the language, and is performed according to dependent structure rules. The dependent structure rules are the rules of grammar of the language. For example, a rule can be, "An adjective modifies the following noun."

The case structure analysis is a process for analyzing the correlation of meaning between words included in a sentence, and is performed according to case structure rules. For example, the case structure rules are generalized by examples of sentences in which the content relation of the language is admitted to be applied by a reasonable human thought. For example, a rule can be, "A proposed action, or an individual or organization receiving a proposal, can be an object of the verb 'propose', and a person or an organization who proposes something can be the subject."

In operation 650, the record sentence generation unit generates a sentence weight for a second candidate record sentence, and again in operation 620, determines whether the sentence weight satisfies the threshold.

Operations 620 through 650 are performed until the sentence weight satisfies the criterion set by the user, e.g., until it is greater than the threshold. If it is determined in operation 620 that the sentence weight is greater than the preset threshold, the second candidate record sentence is selected as a record sentence and the process is finished in operation 660.

In another embodiment of the invention, an operation for determining the appropriateness of the second candidate record sentence may be added between operation 640 and 650. The determination of appropriateness may be performed according to an arbitrary criterion set by the user as well as according to the dependent structure analysis and the case structure analysis. The user criterion can be, for example, the phonetic quality (distortion rate and matching rate) of the synthesized candidate record sentence.

Figure 7:
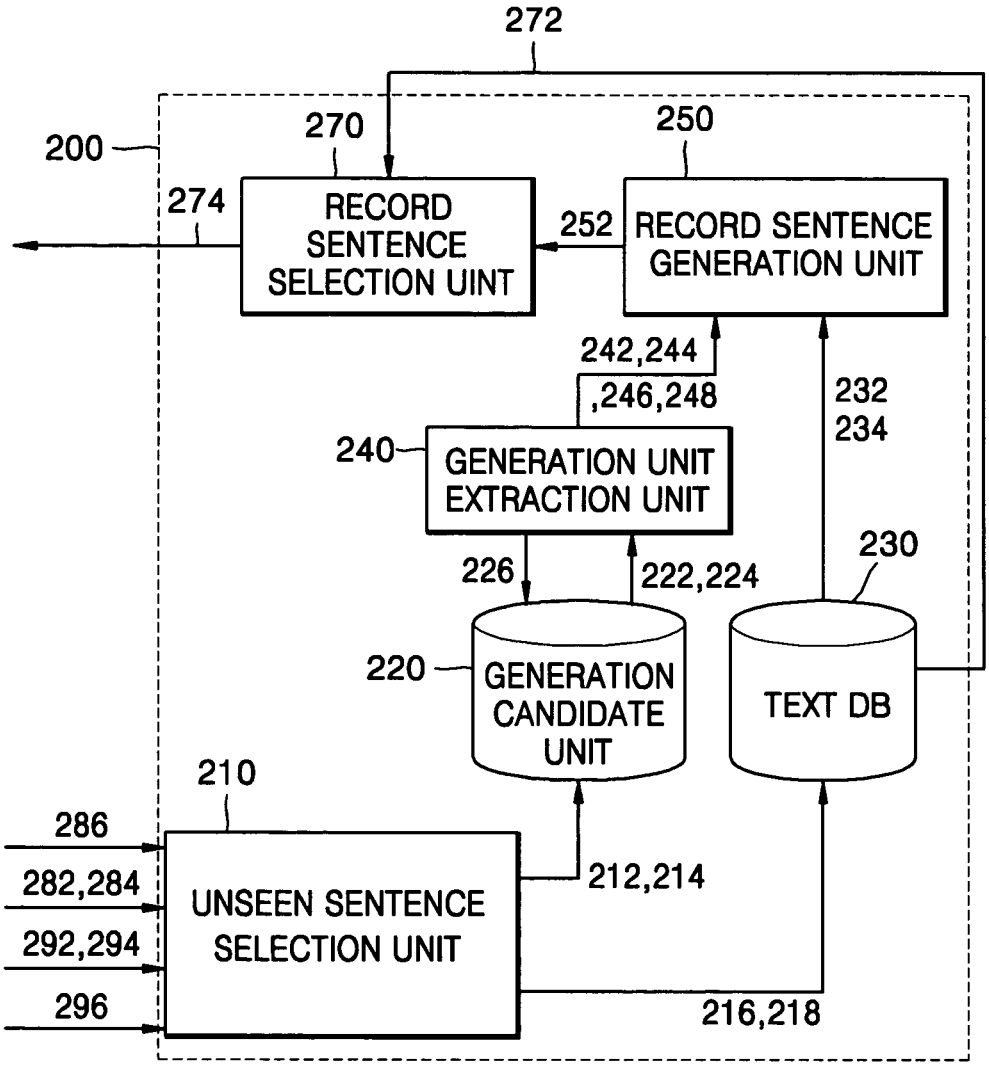
FIG. 7 is a diagram showing a method of generating a record sentence according to an embodiment of the invention.

FIG. 7 is a diagram showing a method for generating a record sentence according to another embodiment of the invention.

The sentence generator 200 according to the embodiment includes: a record sentence selection unit 270 and the unseen sentence selection unit 210, the generation candidate database 220, the text database 230, the generation unit extraction unit 240, and the record sentence generation unit 250.

The record sentence selection unit selects, according to a separate user input, one of a generated record sentence 252 from the record sentence generation unit 250 and a sentence of text 272 from the text database 230, and provides the record sentence to the recording unit 102. All sentences input to the speech synthesizer 260 need to be stored in the speech corpus 100 when the speech corpus 100 is first established.

When the record sentence selection unit 270 selects the sentence of text 272 from the text database 230 as a record sentence 274, all sentences input to the speech synthesizer 260 become record sentences 274.

Figure 8:
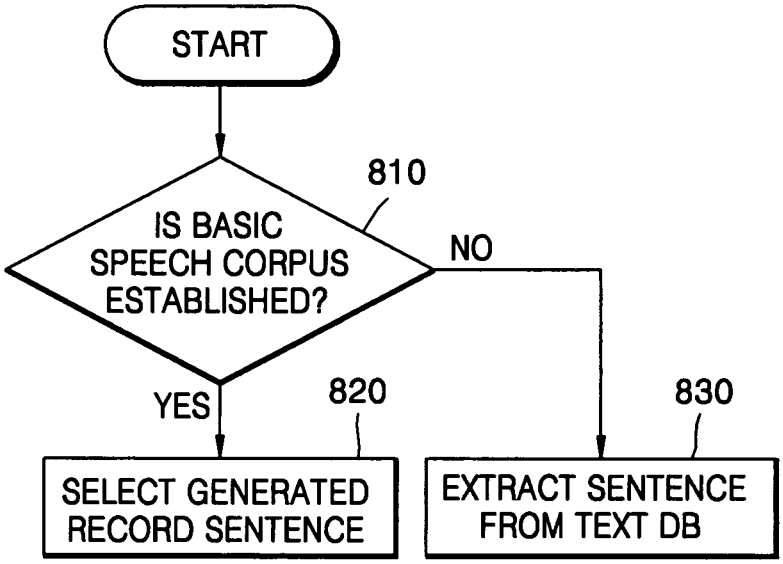
FIG. 8 is a diagram showing the operation of the record sentence selection unit of FIG. 7.

FIG. 8 is a diagram showing the operation of the record sentence selection unit of FIG. 7. In operation 810, the record sentence selection unit 270 receives the record sentence 252 from the record sentence generation unit 250 and the sentence of text 232 from the text database 230, and then, determines whether the received sentence is built into the speech corpus 100. The method for determining whether a received sentence is stored in the speech corpus 100 can be implemented as a simple inquiry as to whether the sentence is in the speech corpus 100.

Also, in another embodiment, in operation 810, a record sentence may be selected arbitrarily by the user such that according to a user input, only the sentence of text 232 from the text database 230, not the record sentence 252 from the record sentence generation unit 250, may be selected for a predetermined period. This method may be useful when the speech corpus 100 is first built.

In operation 810, if it is determined that the sentence is not in the speech corpus 100, operation 820 is performed such that the record sentence 252 from the record sentence generation unit 250 is transmitted to the recording unit 102.

In operation 810, if it is determined that the sentence is in the speech corpus 100, operation 830 is performed such that the record sentence selection unit 270 extracts the sentence from the text database 230 and provides it to the recording unit 102 without change.

The record sentence generation method and the speech corpus establishing method described above can be implemented as a computer readable code, e.g., a computer program. The codes and code segments forming the computer readable code can be inferred or determined by a computer programmer. The computer readable code can be stored/transmitted in a medium, e.g., a computer-readable medium, read and executed by at least one computer such that the record sentence generation method and the speech corpus establishing method are performed. The medium may include a magnetic recording medium and an optical recording medium, for example.

While the invention has been particularly shown and described with reference to exemplary embodiments thereof, it will be understood by those of ordinary skill in the art that various changes in form and details may be made therein without departing from the spirit and scope of the present invention as defined by the following claims. The embodiments should be considered in a descriptive sense only and not for purposes of limitation. Therefore, the scope of the invention is defined not by the detailed description of the invention but by the appended claims and their equivalents.

According to the invention as described above, the speech synthesis process and corpus establishing process are connected in a circular structure such that a record sentence for establishing a speech corpus is automatically generated as speech synthesis is performed. Accordingly, record sentences are efficiently generated, and record sentences capable of covering new unseen units are automatically generated.

In addition, according to the invention, more meaningful sentences are generated as record sentences, according to synthesis information, such that a voice actor can pronounce the sentences more easily, thereby enhancing the quality of recording.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for generating a record sentence to establish a speech corpus, comprising:

generating a synthesized sentence of speech and synthesis information related to speech synthesis by performing speech synthesis for a predetermined sentence of text using candidate synthesis units transmitted from synthesis database;

selecting an unseen sentence including an unseen unit according to the synthesis information;

generating a weight indicating a recording priority of the unseen unit included in the selected unseen sentence;

generating a record sentence by combining the unseen unit with the speech synthesis information according to the generated weight; and updating the speech corpus by storing the record sentence including the unseen unit, wherein the synthesis database is updated based on the updated speech corpus, wherein the unseen unit is selected as a synthesis unit when a speech unit of satisfactory quality cannot be obtained from candidate synthesis units extracted from the synthesis database, and is updated based on the updated synthesis database.

2. The method of generating the record sentence of claim 1, wherein the synthesis information comprises:

text information that is syntactic interpretation information regarding a synthesis unit and a text unit related to the speech synthesis.

3. The method of generating the record sentence of claim 1, wherein the synthesis information comprises:

synthesis unit information that is phonetic interpretation information regarding a synthesis unit and a text unit related to the speech synthesis.

4. The method of generating the record sentence of claim 2, wherein the text information comprises:

linguistic interpretation information regarding the sentence of text.

5. The method of generating the record sentence of claim 3, wherein the synthesis unit information comprises:

phonetic interpretation information regarding the sentence of speech.

6. The method of generating the record sentence of claim 4, wherein the text information comprises:

at least one of a type of sentence, part of speech, information on whether a word of the sentence is an unseen unit, word information, parsing information of the sentence, and/or pause information of the sentence.

7. The method of generating the record sentence of claim 5, wherein the synthesis unit information comprises:

at least one of a prosody matching rate when a synthesis unit is synthesized and/or a distortion rate of a signal waveform of the synthesis unit.

8. The method of generating the record sentence of claim 1, wherein the selecting of the unseen sentence including an unseen unit is performed according to a number of candidate synthesis units extracted from a synthesis database when speech synthesis is performed.

9. The method of generating the record sentence of claim 1, wherein the selecting of the unseen sentence including an unseen unit is performed according to a replacement satisfaction degree of a replacement unit selected when speech synthesis is performed.

10. The method of generating the record sentence of claim 1, wherein the selecting of the unseen sentence including an unseen unit is performed according to a phonetic quality level of the sentence of speech.

11. The method of generating the record sentence of claim 1, wherein selecting of the unseen sentence including an unseen unit is performed according to a prosody matching rate when the synthesis unit is synthesized, or according to a distortion rate of a signal waveform of the synthesis unit.

12. The method of generating the record sentence of claim 1, wherein the generating of the weight comprises:

extracting the unseen unit included in the selected unseen sentence; and generating the weight for the extracted unseen unit, wherein the weight for the unseen unit is determined according to a linguistic criterion and/or a phonetic criterion for the unseen unit.

13. The method of generating the record sentence of claim 12, wherein the weight for the unseen unit is determined according to at least one of the frequency of occurrence of the unseen unit, a type of a word having the unseen unit, a part of speech of the unseen unit, a matching rate of the unseen unit, and/or a distortion rate of the unseen unit.

14. The method of generating the record sentence of claim 12, further comprising:

generating a weight for a word having the unseen unit, wherein the weight for the word is determined according to a linguistic criterion for the word and/or a phonetic criterion for the word.

15. The method of generating the record sentence of claim 14, wherein the weight for the word is determined according to at least one of the weight of the unseen unit, a type of the word, a location of the word, a matching rate of the word and/or the distortion rate of the word.

16. The method of generating the record sentence of claim 14, further comprising:

generating a weight for the sentence having the unseen unit, wherein the weight for the sentence is determined according to a linguistic criterion for the unseen unit and/or a phonetic criterion for the unseen unit.

17. The method of generating the record sentence of claim 16, wherein the weight for the sentence is determined according to at least one of the weight of the unseen unit included in the sentence, the weight of the word included in the sentence, and a type of the sentence.

18. The method of generating the record sentence of claim 1, wherein the generating of the record sentence further comprises:

selecting the unseen unit according to the unseen unit weight; and generating a record sentence by combining the selected unseen unit with the speech synthesis information.

19. The method of generating the record sentence of claim 18, wherein the generating of the record sentence by combining the selected unseen unit with the speech synthesis information comprises:

generating a first candidate record sentence by combining the selected unseen unit with the speech synthesis information; and generating a second candidate record sentence by performing at least one of word replacement, word addition, content word replacement, content word addition, and/or sentence structure modification.

20. The method of generating the record sentence of claim 19, wherein the generating of the second candidate record sentence is performed according to at least one of morpheme analysis, syntax analysis, dependent structure analysis, case structure analysis, and/or semantic analysis.

21. The method of generating the record sentence of claim 19, wherein the generating of the record sentence by combining the selected unseen unit with the speech synthesis information comprises:

generating a weight for the generated second candidate record sentence; and generating a new second candidate record sentence by performing word replacement when the generated sentence weight of the second candidate record sentence is less than a predetermined threshold.

22. A non-transitory medium comprising a computer readable code for performing the method of generating the record sentence of claim 1.

23. A method of establishing a speech corpus, comprising:

performing speech synthesis for a predetermined sentence of text using candidate synthesis units transmitted from a synthesis database;

extracting an unseen unit from an unseen sentence by using synthesis information related to the speech synthesis;

generating a record sentence according to the extracted unseen unit;

converting the record sentence including the unseen unit into a speech signal; and updating by storing the record sentence converted into the speech signal in the speech corpus, wherein the synthesis database is updated based on the updated speech corpus, wherein the unseen unit is selected as a synthesis unit when a speech unit of satisfactory quality cannot be obtained from candidate synthesis units extracted from the synthesis database, and is updated based on the updated synthesis database, the generating of the record sentence is performed by combining the selected unseen unit with the speech synthesis information, and the combining of the selected unseen unit with the speech synthesis information comprises generating a weight according to a linguistic criterion for the unseen unit and extracting the unseen unit in order according to the generated weight.

24. The speech corpus establishing method of claim 23, wherein the combining of the selected unseen unit with the speech synthesis information further comprises generating a weight according to a phonetic criterion for the unseen unit.

25. The speech corpus establishing method of claim 23, wherein the generating of the record sentence comprises:

generating a first candidate record sentence by combining the extracted unseen unit with the speech synthesis information; and generating a second candidate record sentence by performing word replacement for the generated first candidate record sentence.

26. The speech corpus establishing method of claim 25, wherein the generating of the record sentence comprises:

generating a sentence weight for the generated second candidate record sentence; and generating a new second candidate record sentence by again performing word replacement when the sentence weight of the generated second candidate record sentence is less than a predetermined threshold.

27. A non-transitory medium comprising a computer readable code for performing the method of generating the record sentence of claim 23.

28. An apparatus for generating a record sentence for establishing a speech corpus, the apparatus comprising:

a speech synthesis unit that generates a synthesized sentence of speech and synthesis information indicating information related to speech synthesis by performing speech synthesis for a predetermined sentence of text using candidate synthesis units transmitted from a synthesis database;

an unseen sentence selection unit that selects an unseen sentence including an unseen unit according to the generated synthesis information;

a generation unit extraction unit that generates a weight indicating a recording priority of an unseen unit included in the selected unseen sentence; and a record sentence generation unit that generates a record sentence by combining an unseen unit with the speech synthesis information according to the generated weight and automatically updating the speech corpus by storing the record sentence including the unseen unit, wherein the synthesis database is updated based on the updated speech corpus, wherein the unseen unit is selected as a synthesis unit when a speech unit of satisfactory quality cannot be obtained from candidate synthesis units extracted from the synthesis database, and is updated based on the updated synthesis database.

29. The apparatus for generating the record sentence for establishing the speech corpus of claim 28, wherein the record sentence generation unit selects the unseen unit according to the unseen unit weight, generates a first candidate record sentence by combining the selected unseen unit with the speech synthesis information by performing at least one of a word replacement, a word addition, content word replacement, content word addition, and/or sentence structure modification, and generates a second candidate record sentence.

30. The apparatus for generating the record sentence for establishing the speech corpus of claim 29, wherein the generation of the second candidate record sentence is performed according to at least one of morpheme analysis, syntax analysis, dependent structure analysis, case structure analysis, and/or semantic analysis.

31. The apparatus for generating the record sentence for establishing the speech corpus of claim 28, wherein the synthesis information comprises:

synthesis unit information that is phonetic interpretation information regarding a synthesis unit and a text unit related to speech synthesis.

32. The apparatus for generating the record sentence for establishing the speech corpus of claim 31, wherein the synthesis unit information comprises:

phonetic interpretation information regarding a sentence of speech.

33. The apparatus for generating the record sentence for establishing the speech corpus of claim 32, wherein the text information comprises:

at least one of a type of the sentence, parts of speech, information on whether a word is an unseen unit, word information, parsing information of the sentence, and/or pause information.

34. The apparatus for generating the record sentence for establishing the speech corpus of claim 33, wherein the synthesis unit information comprises:

at least one of a prosody matching rate when a synthesis unit is synthesized and/or a distortion rate of a signal waveform of a synthesis unit.

35. The apparatus for generating the record sentence for establishing the speech corpus of claim 28, wherein the unseen sentence selection unit selects the unseen sentence according to at least one of the number of candidate synthesis units extracted from a synthesis database when speech synthesis is performed, and/or a replacement satisfaction degree of a replacement unit selected when speech synthesis is performed.

36. The apparatus for generating the record sentence for establishing the speech corpus of claim 28, wherein the unseen sentence selection unit selects the unseen sentence according to a phonetic quality level of the unseen sentence of speech.

37. The apparatus for generating the record sentence for establishing the speech corpus of claim 36, wherein the unseen sentence selection unit selects the unseen sentence according to a prosody matching rate when the synthesis unit is synthesized and/or according to a distortion rate of a signal waveform of the synthesis unit.

38. The apparatus for generating the record sentence for establishing the speech corpus of claim 28, wherein the generation unit extraction unit extracts the unseen unit included in the selected unseen sentence, and generates a weight for the extracted unseen unit that is calculated according to a linguistic criterion and/or a phonetic criterion of the unseen unit.

39. The apparatus for generating the record sentence for establishing the speech corpus of claim 38, wherein the weight for the unseen unit is generated according to at least one of a frequency of occurrence of the unseen unit, a type of word having the unseen unit, a part of speech of the unseen unit, a matching rate of the unseen unit, and/or a distortion rate of the unseen unit.

40. The apparatus for generating the record sentence for establishing the speech corpus of claim 38, wherein the generation unit extraction unit generates a weight for a word having the unseen unit according to the weight of the unseen unit, and the weight for the word is calculated according to a linguistic criterion for the word and/or a phonetic criterion for the word.

41. The apparatus for generating the record sentence for establishing the speech corpus of claim 40, wherein the weight for the word is generated according to at least one of the weight of the unseen unit, a type of the word, a location of the word, a matching rate of the word, and/or a distortion rate of the word.

42. The apparatus for generating the record sentence for establishing the speech corpus of claim 40, wherein the generation unit extraction unit generates a weight for the sentence having the unseen unit according to the word weight, and the weight for the sentence is calculated according to a linguistic criterion for the unseen unit and/or a phonetic criterion for the unseen unit.

43. The apparatus for generating the record sentence for establishing the speech corpus of claim 42, wherein the weight for the sentence is generated according to at least one of the weight of the unseen unit included in the sentence, the weight of the word included in the sentence, and/or a type of the sentence.

44. The apparatus for generating the record sentence for establishing the speech corpus of claim 28, wherein the synthesis information comprises:

text information that is syntactic interpretation information regarding a synthesis unit and a text unit related to speech synthesis.

* * * * *